US012433374B2

(12) United States Patent
Jung et al.

(10) Patent No.: US 12,433,374 B2
(45) Date of Patent: Oct. 7, 2025

(54) ZIPPER STRAP STRUCTURE, PACKAGING BAG COMPRISING ZIPPER STRAP STRUCTURE, AND MANUFACTURING METHOD FOR ZIPPER STRAP STRUCTURE

(71) Applicant: ZIPPIAN CO., LTD., Gyeonggi-do (KR)

(72) Inventors: Sang Kil Jung, Gyeonggi-do (KR); Won Sang Cho, Gyeonggi-do (KR); Moon Seok Shim, Gyeonggi-do (KR)

(73) Assignee: ZIPPIAN CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/640,850

(22) PCT Filed: Oct. 26, 2021

(86) PCT No.: PCT/KR2021/015100
§ 371 (c)(1),
(2) Date: Mar. 7, 2022

(87) PCT Pub. No.: WO2023/033234
PCT Pub. Date: Mar. 9, 2023

(65) Prior Publication Data

US 2024/0041168 A1 Feb. 8, 2024

(30) Foreign Application Priority Data

Sep. 2, 2021 (KR) ..... 10-2021-0117232

(51) Int. Cl.
*A44B 19/16* (2006.01)
*A44B 19/26* (2006.01)
*B65D 33/25* (2006.01)

(52) U.S. Cl.
CPC ..... *A44B 19/16* (2013.01); *A44B 19/267* (2013.01); *B65D 33/2508* (2013.01)

(58) Field of Classification Search
CPC ..... B29C 48/0013; B29C 2043/026; A44B 19/267; A44B 19/16
See application file for complete search history.

(56) References Cited

U.S. PATENT DOCUMENTS 5,070,584 A * 12/1991 Dais ..... B65D 33/255 24/585.12
2012/0106875 A1 5/2012 Pawloski

FOREIGN PATENT DOCUMENTS

JP H08-58811 A 3/1996
JP 2019-25224 A 2/2019
(Continued)

OTHER PUBLICATIONS

International Search Report for PCT/KR2021/015100 mailed on May 17, 2022.

*Primary Examiner* — Stella K Yi
(74) *Attorney, Agent, or Firm* — The PL Law Group, PLLC

(57) ABSTRACT

A zipper strap structure according to an embodiment includes a first strap, a second strap disposed side by side with the first strap, an internal coupling unit, and an external coupling unit. According to the invention, the internal and external coupling of the zipper strap structure is performed with very high accuracy and precision. In addition, when the zipper strap structure is operated, a user can intuitively recognize whether the zipper strap structure is opened or closed by senses of touch and hearing. Since a user can effectively seal contents by the internal and external coupling of the zipper strap structure and can clearly recognize an operation state of the zipper by senses of touch and hearing, the user does not have to perform repeated checking of whether or not a zipper is completely closed, unlike the related art.

6 Claims, 13 Drawing Sheets

(56) References Cited

FOREIGN PATENT DOCUMENTS

| | | | |
|---|---|---|---|
| JP | 3225400 | U | 3/2020 |
| KR | 20-0467452 | Y1 | 6/2013 |
| KR | 20-0487661 | Y1 | 10/2018 |

* cited by examiner

ZIPPER STRAP STRUCTURE, PACKAGING BAG COMPRISING ZIPPER STRAP STRUCTURE, AND MANUFACTURING METHOD FOR ZIPPER STRAP STRUCTURE

CROSS REFERENCE TO RELATED APPLICATIONS AND CLAIM OF PRIORITY

This application claims benefit under 35 U.S.C. 119, 120, 121, or 365(c), and is a National Stage entry from International Application No. PCT/KR2021/015100, filed Oct. 26, 2021, which claims priority to the benefit of Korean Patent Application No. 10-2021-0117232 filed in the Korean Intellectual Property Office on Sep. 2, 2021, the entire contents of which are incorporated herein by reference.

BACKGROUND

1. Technical Field

The present invention relates to a zipper strap structure, a packaging bag comprising the zipper strap structure, and a manufacturing method for the zipper strap structure, and more specifically, to a zipper strap structure, a packaging bag comprising the zipper strap structure, and a manufacturing method for the zipper strap structure that causes a feeling of use to be felt by both senses of touch and hearing when a zipper is used and that is also effectively sealed.

2. Description of the Related Art

Disposable packaging products are used in a wide variety of ways. Disposable containers made of vinyl or plastic are used to contain most commercial products, and disposable packaging products are also used for product storage for recycling, for waste treatment, or the like. Examples of disposable packaging products which are useful in everyday life include plastic wrap, plastic bags, or the like encountered at home.

In particular, the plastic bags are produced to have various sizes with various materials and shapes to be widely used depending purposes. Among the plastic bags, a product having a mouth, to which a zipper is attached, is sealable and is openable and closable as necessary, thus being more useful for storing perishable food or small items which are easy to lose. An example of the plastic bag is disclosed in Korean Utility Model Registration No. 20-0487661 and the like.

In general, a zipper formed on the plastic bag has a structure in which internal and external parts mesh with each other, and the zipper is made of a flexible plastic material. Hence, when the zipper is not accurately molded, a problem may arise in that the bag is difficult to seal or open. Further, when a slider which forcibly opens and closes a zipper is attached to a bag, a problem may arise in that the structure is complicated or manufacturing costs increases. In particular, when a zipper is deformed or a structure is added to add an additional function (for example, when a zipper operation sound is generated due to a protrusion or the like), a problem of malfunction of zipper opening or closing is more likely to arise, thus being recognized as difficulty of product development.

SUMMARY

Technical objects of the invention are to solve such problems and provide a zipper strap structure, a packaging bag comprising the zipper strap structure, and a manufacturing method for the zipper strap structure that causes a feeling of use to be felt by both senses of touch and hearing when a zipper is used and that is also effectively sealed.

The technical objects of the invention are not limited to those mentioned above, and those skilled in the art are able to clearly understand other unmentioned technical objects from the description to be provided below.

A zipper strap structure according to the invention includes: a first strap; a second strap which is disposed side by side with the first strap while facing the first strap; an internal coupling unit that includes a column portion which projects from the first strap toward the second strap and is extended in a length direction of the first strap and a head portion which has a pair of latching protrusions formed to expand in a width direction of the first strap from an end of the column portion so as to be extended in opposite directions from each other and to be extended in the length direction of the first strap and a central separation groove that is formed by concavely indenting an outer end surface between the latching protrusions toward the column portion and is extended in the length direction of the first strap; and an external coupling unit that includes a pair of wall portions which projects from the second strap toward the first strap, is extended in a length direction of the second strap, and is disposed separately from each other, with an accommodation space being interposed between the wall portions and the accommodation space accommodating the head portion, and a pair of hook portions which is bent from ends of the wall portions toward the accommodation space and is extended in the length direction of the second strap to be hooked to the latching protrusions, respectively.

The internal coupling unit may include the head portion having a height and a width with respect to the first strap that change regularly in the length direction of the first strap.

The head portion may have first head portions disposed to have a first height with respect to the first strap and second head portions formed as parts of the head portion are pressed with pressure applied to the central separation groove and disposed to have a second height which is lower than the first height with respect to the first strap, the first and second head portions being arranged alternately in the length direction of the first strap.

When the internal coupling unit is coupled to the external coupling unit, a gap between a latching protrusion of the second head portions and one of the hook portions of the external coupling unit may be smaller than a gap between a latching protrusion of the first head portions and one of the hook portions of the external coupling unit.

When the internal coupling unit is coupled to the external coupling unit, a difference between a gap between a latching protrusion of the first head portions and one of the hook portions of the external coupling unit and a gap between a latching protrusion of the second head portions and one of the hook portions of the external coupling unit may be smaller than a difference between the first height and the second height.

A width of the second head portions may be wider than a width of the first head portions.

A width of a column portion supporting the second head portions may be wider than a width of a column portion supporting the first head portions.

A depth of the central separation groove may not exceed a height of the head portion only, the height being obtained by subtracting a height of the column portion from a height of the head portion.

The head portion may be formed to have an asymmetric structure in which one of the pair of latching protrusions is larger than the other latching protrusion.

The packaging bag comprising a zipper strap structure according to the invention may be formed to have an opening to which the zipper strap structure is attached.

A manufacturing method for a zipper strap structure according to the invention includes: (a) molding a first strap and an internal coupling unit to have a uniform cross section by extrusion molding, the internal coupling unit including a column portion which projects from the first strap and is extended in a length direction of the first strap and a head portion which has a pair of latching protrusions formed to expand in a width direction of the first strap from an end of the column portion and to be extended in the length direction of the first strap and a central separation groove that is formed by concavely indenting an outer end surface of the column portion between the latching protrusions and that is extended in the length direction of the first strap; and (b) repeatedly pressing parts of the head portion to deform a cross section of the internal coupling unit by a pressurizing device, where pressure is applied to the central separation groove to pressurize and expand the latching protrusions of second head portions toward both sides and first head portions and the second head portions are alternately arranged in the length direction of the first strap, the first head portions being disposed to have a first height with respect to the first strap, the second head portions being disposed to have a second height which is lower than the first height with respect to the first strap.

The manufacturing method for a zipper strap structure may further include: (c) molding a second strap and an external coupling unit to have a uniform cross section by extrusion molding, the external coupling unit including a pair of wall portions which projects from the second strap, is extended in a length direction of the second strap, and is disposed separately from each other, with an accommodation space being interposed between the wall portions and the accommodation space accommodating the head portion, and a pair of hook portions which is bent from ends of the wall portions toward the accommodation space and is extended in the length direction of the second strap.

When the internal coupling unit is coupled to the external coupling unit, deformation performed in (b) may cause a gap between a latching protrusion of the second head portions and one of the hook portions of the external coupling unit in (c) to be smaller than a gap between a latching protrusion of the first head portions and one of the hook portions of the external coupling unit.

According to the invention, the internal and external coupling of the zipper strap structure is performed with very high accuracy and precision. In addition, when the zipper strap structure is operated, a user can intuitively recognize whether the zipper strap structure is opened or closed by senses of touch and hearing. Hence, the zipper strap structure can be applied to a packaging bag or the like and can be practically used to seal contents therein. In particular, since a user can effectively seal contents by the internal and external coupling of the zipper strap structure and can clearly recognize an operation state of the zipper by senses of touch and hearing, the user does not have to perform repeated checking of whether or not a zipper is completely closed, unlike the related art. Further, the invention can provide a very convenient and effective manufacturing method for the zipper strap structure improved as described above and remarkably reduce a defect rate in a manufacturing process to encourage various products which have to include an improved zipper structure to be manufactured.

DETAILED DESCRIPTION OF THE EMBODIMENTS

Advantages, features, and methods for achieving the advantages and the features are to be clarified with reference to embodiments which will be described below in detail together with the accompanying drawings. However, the invention is not limited to the embodiments to be disclosed below but can be realized as various different embodiments. The embodiments are only provided to completely describe the disclosure of the invention and to completely inform a person with ordinary skill in the technical field to which the invention pertains of the scope of the invention, and the invention is defined only by the claims. Through the entire specification, the same reference signs represent the same configurational elements.

Hereinafter, a zipper strap structure, a packaging bag comprising the zipper strap structure, and a manufacturing method for the zipper strap structure according to the invention will be described in detail with reference to FIGS. 1 to 20. First, the zipper strap structure will be described in detail with reference to FIGS. 1 to 8 in order to provide brief and clear descriptions thereof, and then the packaging bag comprising the zipper strap structure and the manufacturing method for the zipper strap structure will be described in this order based on the descriptions with reference to the rest of the drawings.

Figure 1:
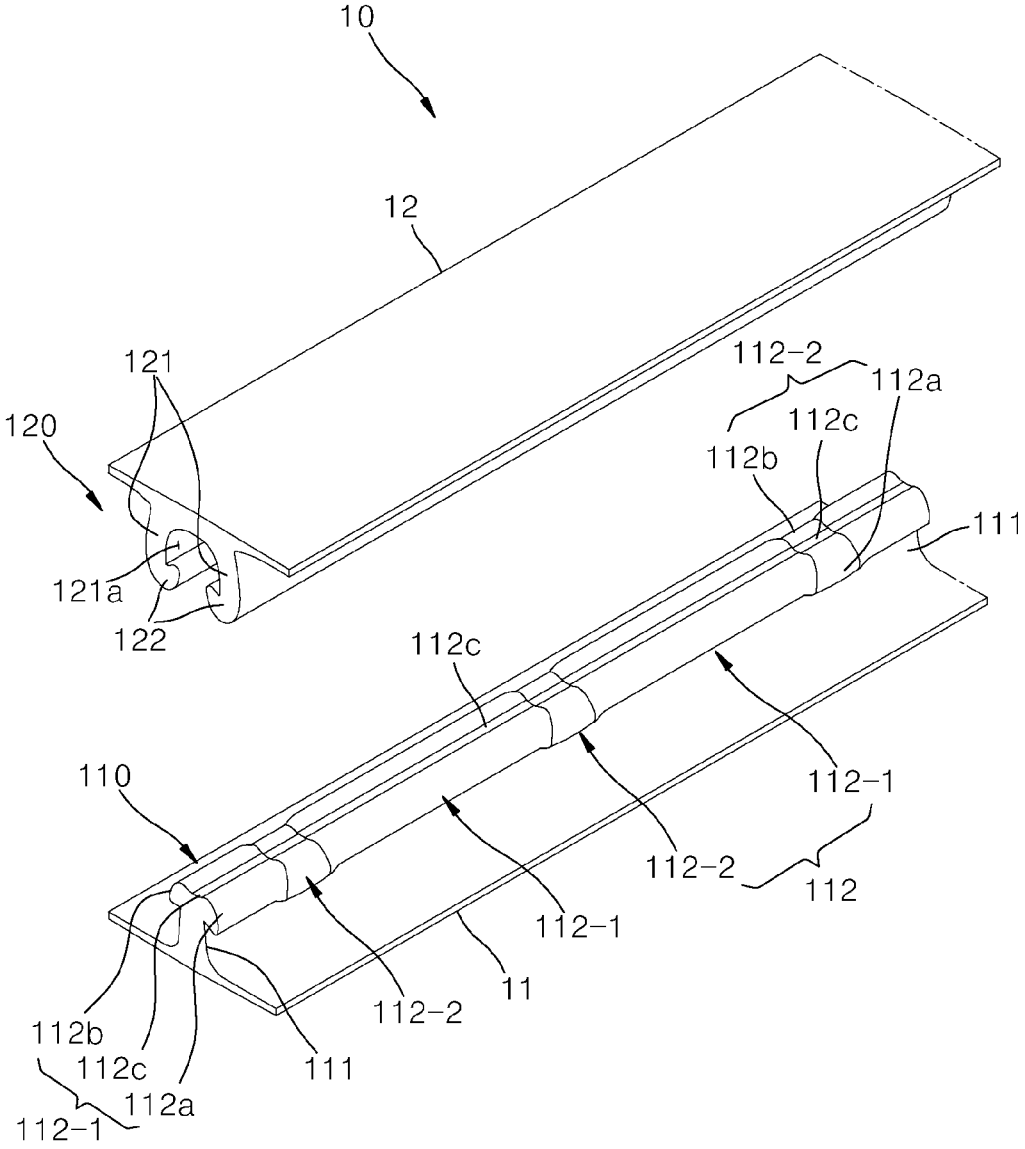
FIG. 1 is a perspective view of a zipper strap structure according to an embodiment of the invention.
Figure 2:
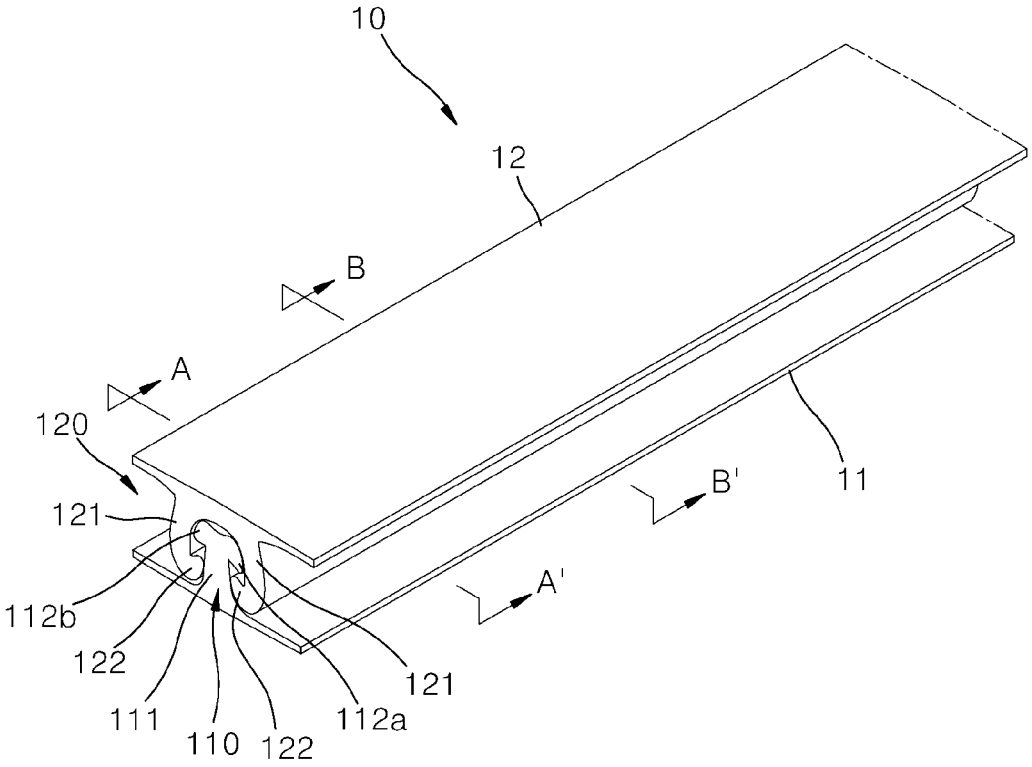
FIG. 2 is a view illustrating a coupled state of the zipper strap structure in FIG. 1.
Figure 3:
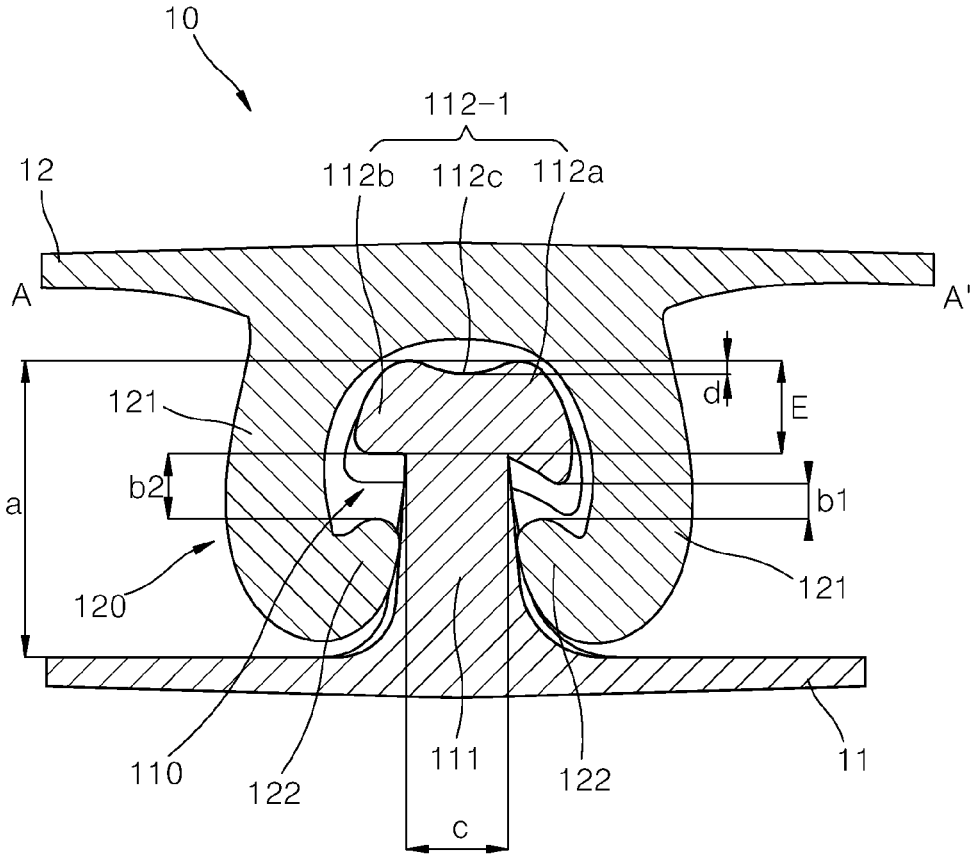
FIG. 3 is a cross-sectional view taken along line A-A' of the zipper strap structure in FIG. 2.
Figure 4:
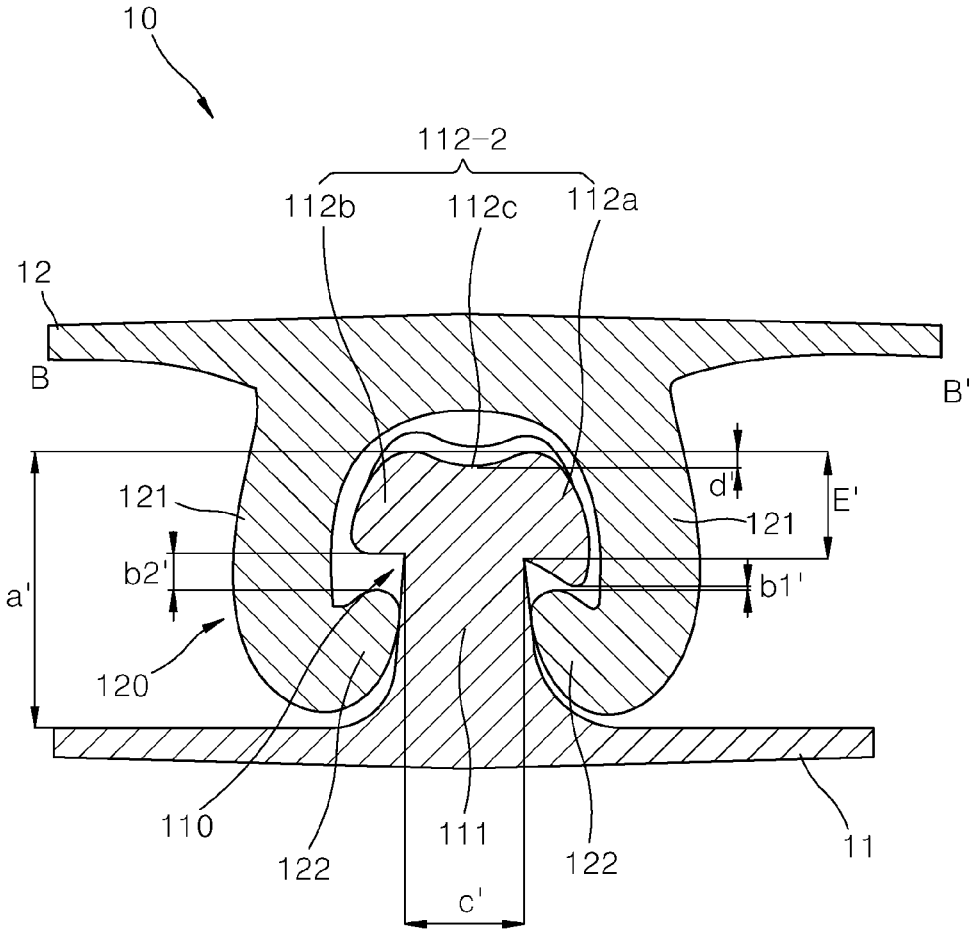
FIG. 4 is a cross-sectional view taken along line B-B' of the zipper strap structure in FIG. 2.

FIG. 1 is a perspective view of a zipper strap structure according to an embodiment of the invention. FIG. 2 is a view illustrating a coupled state of the zipper strap structure in FIG. 1. FIG. 3 is a cross-sectional view taken along line A-A' of the zipper strap structure in FIG. 2. FIG. 4 is a cross-sectional view taken along line B-B' of the zipper strap structure in FIG. 2. In particular, a cross section taken along line A-A' in FIG. 3 represents a cross section viewed when cutting a first head portion, and a cross section taken along line B-B' in FIG. 4 represents a cross section viewed when cutting a second head portion.

With reference to FIGS. 1 to 4, a zipper strap structure 10 according to the invention includes an internal coupling unit 110 and an external coupling unit 120. The internal and external coupling units are separately disposed at a first strap 11 and a second strap 12, respectively. When the internal coupling unit 110 and the external coupling unit 120 come into a decoupled state, the internal and external coupling units can be viewed as illustrated in FIG. 1 and can be coupled to each other as illustrated in FIG. 2 when coming into close contact with each other by applying pressure to at least one side thereof. FIGS. 1 and 2 may be views illustrating a part of the zipper strap structure 10; however, the entire zipper strap structure is configured of the same repeated structures, thus being substantially the same as the views illustrated in FIGS. 1 and 2. The zipper strap structure 10 can be extended as necessary by repeatedly attaching the illustrated structure. The zipper strap structure 10 can be variously applied to products such as a packaging bag which is to be opened and closed by a zipper.

In particular, the zipper strap structure 10 according to the invention has a central separation groove (refer to reference sign 112*c* in FIGS. 1, 3, and 4) between protrusions (latching protrusions 112*a* and 112*b*) formed at the internal coupling unit 110. As illustrated in FIG. 1, the central separation groove 112*c* is extended in a length direction of the internal coupling unit 110 and is disposed along the entire head (first and second head portions 112-1 and 112-2) of the internal coupling unit 110, the head having a height and a width which change in the length direction of the internal coupling unit. The central separation groove 112*c* fulfills a function of uniformly distributing pressure to both sides of the groove when the head is caused to have different heights by applying pressure to the head (that is, head portion 112) of the internal coupling unit 110. In this manner, the invention obtains an accurately shaped cross section of the internal coupling unit 110 as illustrated in FIGS. 3 and 4. The central separation groove 112*c* fulfills a very important function of controlling a process such that a shape of the protrusions is maintained and the buckling due to pressure deflection is inhibited when a structure (first and second head portions 112-1 and 112-2) having different heights is formed at the internal coupling unit 110.

Consequently, according to the invention, the internal coupling unit 110 can have a regular pattern structure of the first head portions 112-1 and the second head portions 112-2 which are straightly aligned without buckling and change in height and width, while maintaining a protrusion structure. Due to such regular structure, the external coupling unit 120 and the internal coupling unit 110 are coupled to and decoupled from each other with repeated contact sounds, and a user can regularly have sense of touch felt from contact parts. In addition, since the internal coupling unit 110 is straightly disposed without buckling and the protrusion structure maintains an accurate shape as intended, the protrusion structure comes into close contact with the external coupling unit 120 to tightly seal a space between the external coupling unit 120 and the internal coupling unit 110.

The zipper strap structure 10 of the invention is specifically configured as follows. The zipper strap structure 10 includes: the first strap 11; the second strap 12 which is disposed side by side with the first strap 11 while facing the first strap 11; the internal coupling unit 110 that includes a column portion 111 which projects from the first strap 11 toward the second strap 12 and is extended in the length direction of the first strap 11 and the head portion 112 which has a pair of latching protrusions 112*a* and 112*b* formed to expand in a width direction of the first strap 11 from an end of the column portion 111 so as to be extended in opposite directions from each other and to be extended in the length direction of the first strap 11 and the central separation groove 112*c* that is formed by concavely indenting an outer end surface between the latching protrusions 112*a* and 112*b* toward the column portion 111 and is extended in the length direction of the first strap 11; and the external coupling unit 120 that includes a pair of wall portions 121 which projects from the second strap 12 toward the first strap 11, is extended in a length direction of the second strap 12, and is disposed separately from each other, with an accommodation space 121*a* being interposed between the wall portions and the accommodation space accommodating the head portion 112, and a pair of hook portions 122 which is bent from ends of the wall portions 121 toward the accommodation space 121*a* and is extended in the length direction of the second strap 12 to be hooked to the latching protrusions 112*a* and 112*b*, respectively.

In particular, in the embodiment of the invention, the internal coupling unit 110 includes the head portion 112 having a height and a width with respect to the first strap 11 that change regularly in the length direction of the first strap 11 (refer to FIG. 1). Hence, the head portion 112 can have the first head portions 112-1 disposed to have a first height (refer to reference sign a in FIG. 3) with respect to the first strap 11 and the second head portions 112-2 as parts of the head portion 112 which are formed by being pressed with pressure applied to the central separation groove 112*c* and are disposed to have a second height (refer to reference sign a' in FIG. 4) which is lower than the first height with respect to the first strap 11, the first and second head portions being arranged alternately in the length direction of the first strap 11. Hereinafter, configurations, operational effects, and the like of the invention will be described in detail based on the embodiments of the invention.

With reference to FIG. 1, the first strap 11 and the second strap 12 can be disposed side by side with each other while facing each other. Each of the first and second straps can be formed to have a uniform width and have a length longer than the width. The first strap 11 and the second strap 12 can be made of a flexible plastic material and can be opaque or transparent. The first and second straps can change colors, respectively, depending on the material and can have the same color or different colors from each other. The first strap 11 and the second strap 12 can be extended by a length as needed, thereby being provided to be fitted for various products. For example, when the zipper strap structure 10 is applied to a mouth of a plastic packaging bag or the like, each of the first strap 11 and the second strap 12 can have a length corresponding to a half of a circumference of the mouth. For example, the first strap 11 and the second strap 12 can have a width of several millimeters or about 1 centimeter, and the length can be extended as needed depending on an application target. However, the invention does not have to be limited thereto, and the width of each strap can be increased as wide as possible. The first strap 11 and the second strap 12 can have a surface formed by the width and the length, thus, being attached to an application product by an outer flat surface. In addition, the first and second straps are attached and then fixed to the application product to support the internal coupling unit 110 and the external coupling unit 120 which project from inner surfaces on opposite sides.

The internal coupling unit 110 projects from the first strap 11, and the external coupling unit 120 projects from the second strap 12. As illustrated in FIGS. 1 and 2, the internal coupling unit 110 projects towards the second strap 12, and the external coupling unit 120 projects toward the first strap 11. In other words, the internal coupling unit 110 and the external coupling unit 120 project toward each other from respective inner surfaces of the first and second straps, the inner surfaces facing each other. The internal coupling unit 110 projects from the first strap 11 toward the second strap 12 and includes the column portion 111 extended in the length direction of the first strap 11 and the head portion 112 disposed at an end of the column portion 111. The head portion 112 has a structure in which the pair of latching protrusions 112*a* and 112*b* is formed to expand in a width direction of the first strap 11 from the end of the column portion 111 so as to be extended in opposite directions from each other and to be extended in the length direction of the first strap 11 and the central separation groove 112*c* is formed by concavely indenting an outer end surface between the latching protrusions 112*a* and 112*b* toward the column portion 111 and is extended in the length direction of the first strap 11. In other words, the head portion 112 includes the pair of latching protrusions 112*a* and 112*b* and the central separation groove 112*c* disposed between the latching protrusions 112*a* and 112*b*. The central separation groove 112*c* has a groove structure in which concave indenting is performed toward the column portion 111 in an opposite direction to a projection direction of the column portion 111 and also has an extended groove structure in which the groove having a concave indenting shape is extended to elongate in the length direction of the first strap 11. As illustrated in FIG. 1, the central separation groove 112*c* is provided on the entire head portion 112 to cross between the latching protrusions 112*a* and 112*b*.

In particular, as illustrated in FIGS. 1, 3, and 4, the internal coupling unit 110 is formed to have a structure in which a height and a width of the head portion 112 with respect to the first strap 11 change regularly in the length direction of the first strap 11. Hence, the head portion 112 can include the first head portions 112-1 having a relatively higher height and the second head portions 112-2 having a relatively lower height. As illustrated in FIG. 1, the first head portions 112-1 and the second head portions 112-2 are arranged alternately in the length direction of the first strap 11. In other words, the first head portions 112-1 and the second head portions 112-2 can be repeatedly disposed on the entire internal coupling unit 110 in the length direction of the first strap 11. The specific structure of the first head portions 112-1 and the second head portions 112-2 will be described below in more detail. The internal coupling unit 110 can be integrally molded with the first strap 11 and can be made of the same material as the first strap 11. However, the material does not have to be limited thereto, and the material can be changed through a method of multi-material molding (including injection molding) or the like using two or more materials, as necessary, for example. The internal coupling unit 110 projecting from the first strap 11 can be formed by various methods.

The external coupling unit 120 includes a pair of wall portions 121 which projects from the second strap 12 toward the first strap 11, is extended in the length direction of the second strap 12, and is disposed separately from each other, with an accommodation space 121*a* being interposed between the wall portions and the accommodation space accommodating the head portion 112, and a pair of hook portions 122 which is bent from ends of the wall portions 121 toward the accommodation space 121*a* and is extended in the length direction of the second strap 12 to be hooked to the latching protrusions 112*a* and 112*b* of the internal coupling unit 110, respectively. The external coupling unit 120 is formed with a cross section having a uniform shape and does not have a structure in which the height changes unlike the internal coupling unit 110. The invention has a structural characteristic of maximizing flexibility without damaging the flexibility of the external coupling unit 120 by not deforming the external coupling unit 120. As will be described below, the structure, in which the height changes regularly, is mainly provided on a side of the internal coupling unit 110, and the external coupling unit 120 maintains the uniformly shaped cross section. The external coupling unit 120 can also be integrally molded with the second strap 12 and can be made of the same material as the second strap 12, and the material can be changed through a method of multi-material molding (including injection molding) or the like using two or more materials, as necessary. The external coupling unit 120 can also be formed by causing the external coupling unit to project from the second strap 12 by various methods.

Hereinafter, structural characteristics of the zipper strap structure will be described in more detail with reference to FIGS. 3, 4, 5 to 8.

Figure 5:
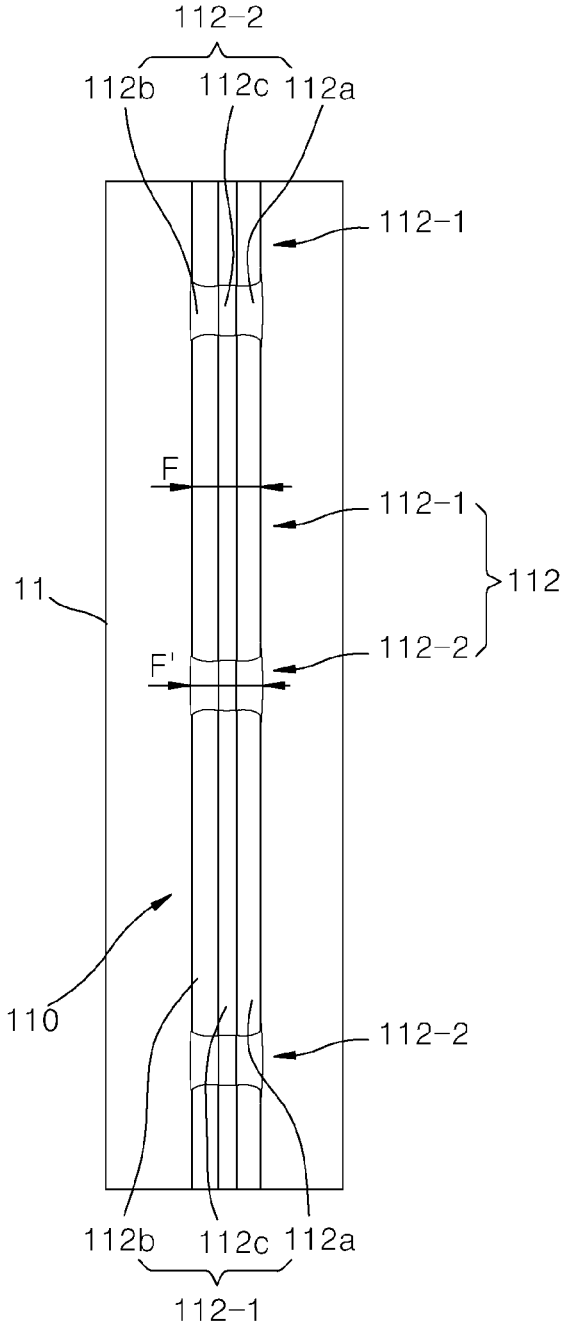
FIG. 5 is a view of the zipper strap structure viewed from a side on which an internal coupling unit projects.
Figure 6:
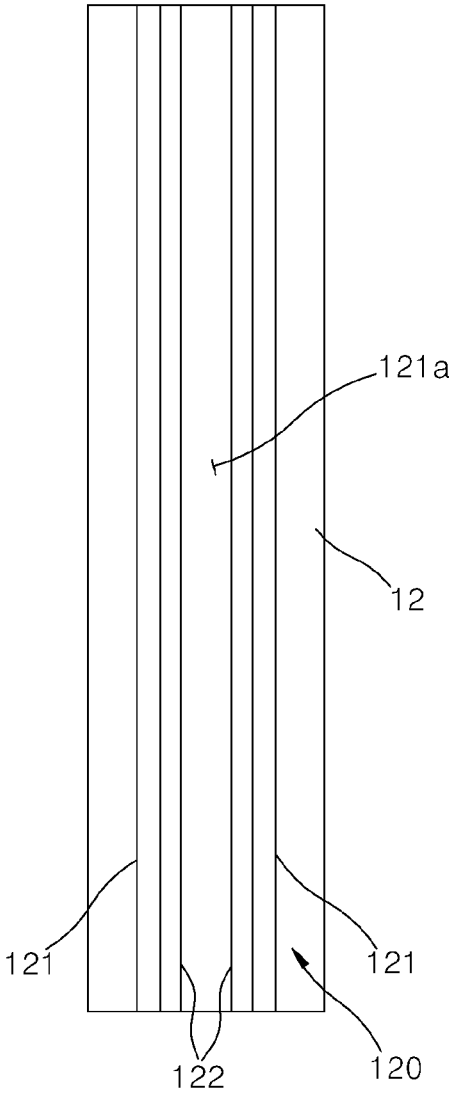
FIG. 6 is a view of the zipper strap structure viewed from a side on which an external coupling unit projects.
Figure 7:
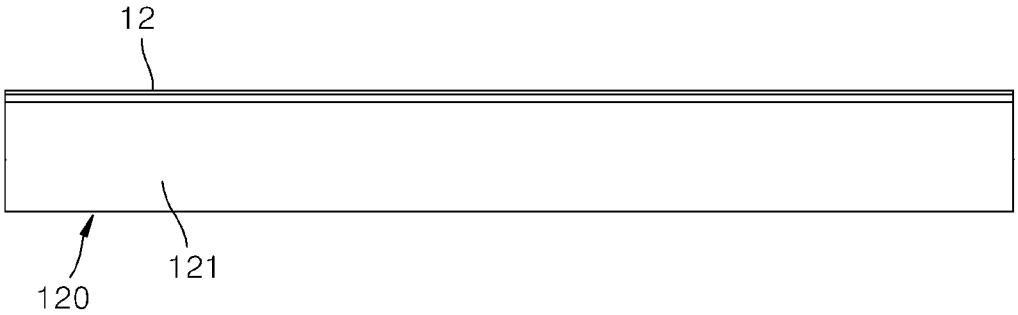
FIG. 7 is a side view of the external coupling unit of the zipper strap structure in FIG. 1.
Figure 8:
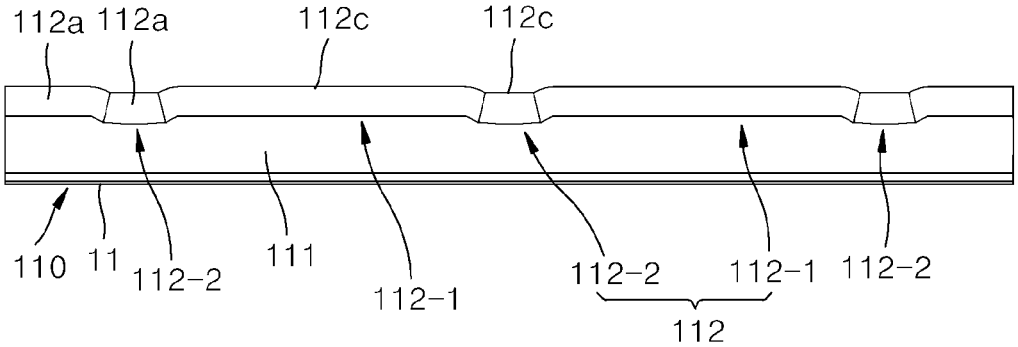
FIG. 8 is a side view of the internal coupling unit of the zipper strap structure in FIG. 1.

FIG. 5 is a view of the zipper strap structure viewed from a side on which the internal coupling unit projects. FIG. 6 is a view of the zipper strap structure viewed from a side on which the external coupling unit projects. FIG. 7 is a side view of the external coupling unit of the zipper strap structure in FIG. 1. FIG. 8 is a side view of the internal coupling unit of the zipper strap structure in FIG. 1.

The zipper strap structure 10 has a structure in which the external coupling unit 120 and the internal coupling unit 110 described above are coupled to each other. In particular, the internal coupling unit 110 includes the first head portions 112-1 and the second head portions 112-2 which have different heights and are disposed to form a regular pattern such that contact sounds and tactile feelings which inform a user of an operation state can be provided to the user. For example, in a case of a plastic product which elongates in the length direction as described in the invention, repeated deformation in the length direction like a height change can be performed through secondary pressurization after primary molding; however, a part to which pressure is applied through the secondary pressurization can often have a defect due to excessive deformation or buckling. In particular, in a case of the invention having a small width measured by unit of millimeter, individual structures are very fine, and thus a shape is likely to be broken or damaged even by low pressure. As described above, in the invention, such a problem is solved using the central separation groove 112*c*, and the structure in which only the height and the width of the head portion 112 substantially change to form the regular pattern is realized through pressure distribution performed by the central separation groove 112*c* while the column portion 111, the latching protrusions 112*a* and 112*b*, and the like maintain a normal shape and direction as intended. A manufacturing process related thereto will be described below in more detail. Hereinafter, structural characteristics of the invention realized through the manufacturing process will be more specifically observed.

The head portion 112 includes the first head portions 112-1 disposed to have a first height a with respect to the first strap 11 as illustrated in FIG. 3 and the second head portions 112-2 disposed to have a second height a' which lower than the first height with respect to the first strap 11 as illustrated in FIG. 4. As illustrated in FIGS. 5 and 8, the first head portions 112-1 and the second head portions 112-2 are arranged alternately in the length direction of the first strap 11. For example, the first head portion 112-1 can have a length longer than a length of the second head portion 112-2 in the length direction of the first strap 11, and thus the second head portions 112-2 having a substantially lower height are found to be regularly arranged between the first head portions 112-1. In particular, the second head portions 112-2 are formed when parts of the head portion 112 are pressed with pressure applied to the central separation groove 112*c* at the top. In other words, when the second head portions 112-2 are formed, the central separation groove 112*c* is pressurized, and thereby the pressure can be appropriately distributed. In this manner, as illustrated in FIG. 4, a cross-sectional structure in which the column portion 111 and the latching protrusions 112*a* and 112*b* maintain shapes thereof as intended and the column portion 111 projects perpendicularly from the first strap 11 without buckling can be formed.

The external coupling unit 120 holds both sides of the internal coupling unit 110 by the wall portions 121 disposed as a pair. The hook portions 122 are bent toward the accommodation space (refer to reference sign 121*a* in FIG. 6) between the wall portions 121 to be hooked to the latching protrusions 112*a* and 112*b* of the internal coupling unit 110. Such a structure can result in a difference in coupling structure particularly between the first head portions 112-1 and the second head portions 112-2 which have different heights and, specifically, can include the following. First, with reference to FIGS. 3 and 4, when the internal coupling unit 110 is coupled to the external coupling unit 120, gaps (refer to reference signs b1' and b2' in FIG. 4) between the latching protrusions 112*a* and 112*b* of the second head portion 112-2 and the hook portions 122 of the external coupling unit 120 can be smaller than gaps (refer to reference signs b1 and b2 in FIG. 3) between the latching protrusions 112*a* and 112*b* of the first head portions 112-1 and the hook portions 122 of the external coupling unit 120. In other words, the latching protrusions 112*a* and 112*b* of the second head portion 112-2 can be more closely coupled to the hook portions 122 of the external coupling unit 120.

In addition, when the internal coupling unit 110 is coupled to the external coupling unit 120, a difference (which can be obtained by b1-b1' and b2-b2', respectively) between the gaps b1 and b2 between the latching protrusions 112*a* and 112*b* of the first head portions 112-1 and the hook portions 122 of the external coupling unit 120 and the gaps b1' and b2' between the latching protrusions 112*a* and 112*b* of the second head portion 112-2 and the hook portions 122 of the external coupling unit 120 can be smaller than a difference (which can be obtained by a-a') between the first height a and the second height a'. In other words, the latching protrusions 112*a* and 112*b* can be more moved toward the hook portions 122 than the difference in height between the first head portions 112-1 and the second head portions 112-2 which are pressed by pressure. This can also be a result of an appropriate pressure distribution effect of the central separation groove 112*c*. Further, as illustrated in FIG. 5, a width F' of the second head portions 112-2 can be wider than a width F of the first head portions 112-1, and this can be a result of a deformation effect by the pressure. Consequently, the second head portion 112-2 having the relatively wider width can be more strongly hooked to the hook portions 122.

In addition, as illustrated in FIGS. 3 and 4, a width c' of the column portion 111 supporting the second head portions 112-2 can be wider than a width c of the column portion 111 supporting the first head portions 112-1. The width of the column portion 111 is illustrated based on a width measured at a connection point thereof to the head portion. Both the column portion 111 supporting the first head portions 112-1, to which the pressure is not applied, and the column portion 111 supporting the second head portions 112-2, to which the pressure is applied, substantially maintain a perpendicular state to the first strap 11 and the deformation is limited only to an increase in width of the column portion 111. The pressure distribution toward both sides from the central separation groove 112*c* can result in the deformation limited to an increase in height and width c' without buckling of the column portion 111 by using the central separation groove 112*c*.

The difference in coupling structure between the second head portions 112-2 and the first head portions 112-1 is repeatedly generated to form a regular pattern between the second head portions 112-2 and the first head portions 112-1 which are alternately disposed, and thus an interaction between the differences can result in a sound effect having a regular pattern. For example, since the width c' of the column portion 111 and the width F' of the second head portions 112-2 which are arranged to form a regular pattern are relatively large and the gaps b1' and b2' between the latching protrusions 112*a* and 112*b* and the hook portions 122 are relatively small, the second head portions can be more strongly coupled to the external coupling unit 120 than the first head portions 112-1 can. Hence, when the external coupling unit 120 and the internal coupling unit 110 are pushed to be coupled to each other or are pulled out to be decoupled from each other, a subtle difference in external force, a difference in coupling or decoupling time, a difference in elastic force which is generated by a difference in structure, a difference in vibration (or vibration sound) due to the difference in elastic force, or the like can be regularly generated, and thus sound effects resulting from the differences can be generated when the external coupling unit 120 and the internal coupling unit 110 are opened or closed. In addition, since a user touches both the external coupling unit 120 and the internal coupling unit 110 in a way of rubbing or the like while applying pressure by hand, the user can more strongly feel regular changes of the internal coupling unit 110 even by a feeling of touch during contact. As a result, the user can sensibly recognize to clearly know a closing or opening movement when the zipper strap structure 10 is opened or closed.

In addition, despite the difference in coupling structure as described above, all of the first head portions 112-1 and the second head portions 112-2 of the column portion 111 maintain the perpendicular state to the first strap 11 and come into close contact with the wall portions 121 of the external coupling unit 120 as illustrated in FIGS. 3 and 4, and thus the external coupling unit 120 and the internal coupling unit 110 are very tightly sealed. As illustrated in FIGS. 3 to 8, the head portion 112 can have an asymmetric structure in which one of the pair of latching protrusions 112*a* and 112*b* is larger than the other, and the asymmetric structure can also be accurately maintained at both the first head portions 112-1 and the second head portions 112-2 due to the above-described pressure distribution of the central separation groove 112*c*. For example, a relatively larger one of the latching protrusions 112*a* and 112*b* can be disposed on an inner side on which contents of the packaging bag or the like is put so as not to be decoupled due to pressure or the like of the contents, and a relatively smaller one of the latching protrusions 112*a* and 112*b* can be disposed on a side toward a mouth opposite the inner side so as to enable a person to more easily open the mouth when the person opens the mouth.

As described above, the central separation groove 112*c* which distributes pressure during pressurization fulfills a very important function to making the structure, and effects of the above-described structure can be more appropriately obtained depending on a size of the central separation groove 112*c*. Preferably, a depth (refer to reference sign d in FIGS. 3 and 4) of the central separation groove 112*c* may not exceed a height (refer to reference signs E or E' in FIGS. 3 and 4) of the head portion only, the height being obtained by subtracting a height of the column portion 111 from a height of the head portion. In other words, the central separation groove 112*c* is formed to have the depth which does not exceed the height of the head portion, and thereby a pressure distribution effect can be added while the hardness of the entire internal coupling unit 110 is maintained as it is. A partial difference can be observed between the height E of the first head portion 112-1 only and the height E' of the second head portion 112-2 only by the deformation or the like due to the pressure; however, the central separation groove 112*c* can be formed to have the depth which does not exceed the height of the head portion only. The zipper strap structure 10 of the invention can be configured of the structure described above.

Hereinafter, a packaging bag comprising the zipper strap structure according to the invention will be described in detail with reference to FIG. 9. The zipper strap structure to be mentioned below is substantially the same as the above-described zipper strap structure, thus equivalently including technical features of the above-described zipper strap structure. Hence, the zipper strap structure is not repeatedly described, and the description of the zipper strap structure which is not mentioned otherwise is completely substituted with the above-provided description thereof.

Figure 9:
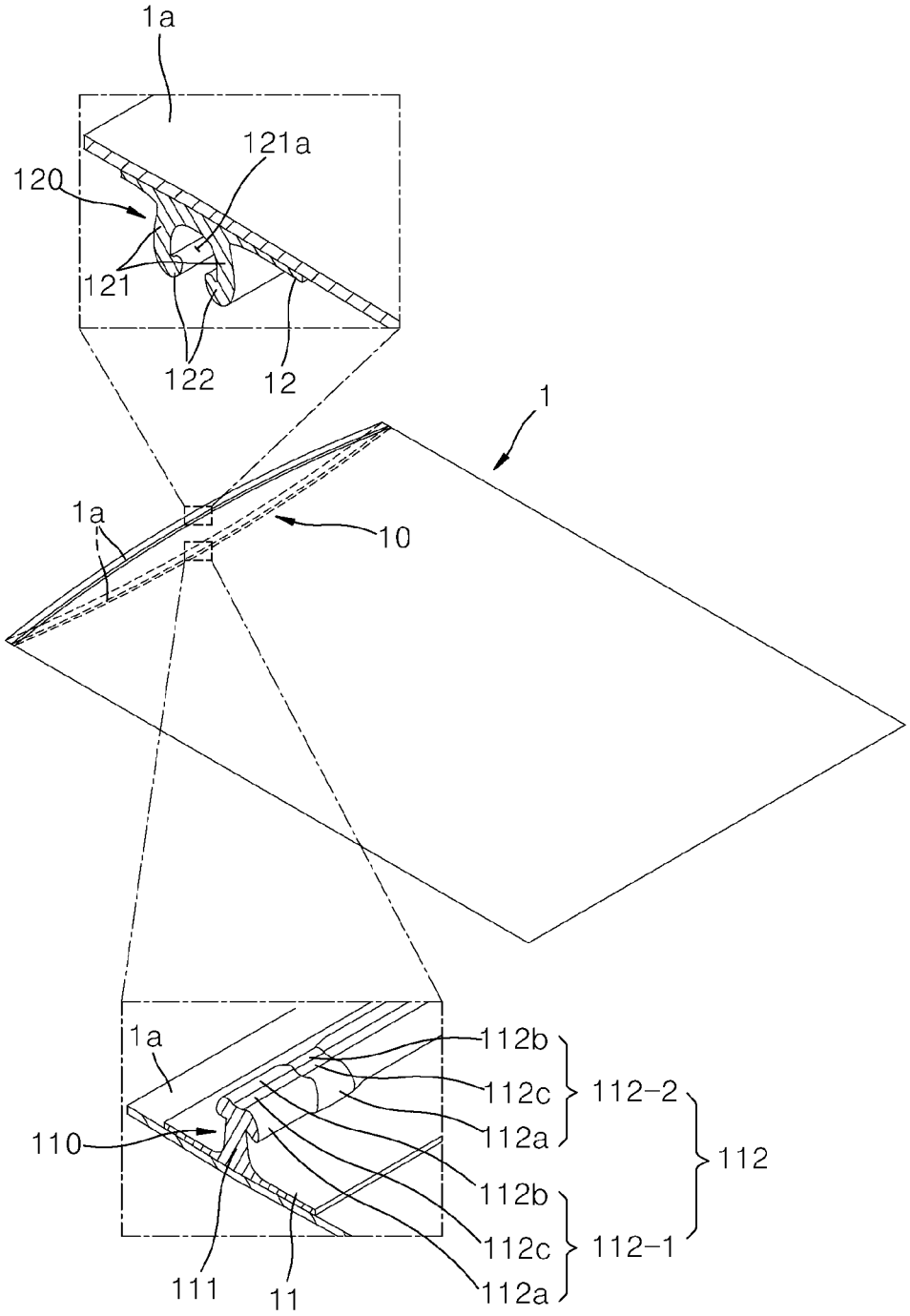
FIG. 9 is a perspective view of a packaging bag comprising the zipper strap structure according to the embodiment of the invention.

FIG. 9 is a perspective view of the packaging bag comprising the zipper strap structure according to the embodiment of the invention. Enlarged views in FIG. 9 illustrate cross sections of enlarged parts.

An embodiment of a packaging bag 1 comprising the zipper strap structure is described based on the description of the zipper strap structure 10 described above. With reference to FIG. 9, the packaging bag 1 comprising the zipper strap structure can be formed to have an opening 1*a* of the packaging bag 1 to which the above-described zipper strap structure 10 is attached. The packaging bag 1 can be made of a material such as vinyl, and the opening 1*a* can be a mouth of the packaging bag 1. A side of the packaging bag 1 opposite the opening 1*a* is blocked to contain contents inside, and a size or a volume of the packaging bag can be changed as necessary. When a change in size or volume results in a change in size of the opening 1*a*, the length, the width, or the like of the zipper strap structure 10 can be changed corresponding thereto, and thus the opening 1*a* of the packaging bag 1 can be easily sealed by the zipper strap structure 10.

When the opening 1*a* of the packaging bag 1 is opened or closed, for example, a user can apply pressure by hand to perform manipulation by rubbing or pulling out the opening 1*a* or the zipper strap structure 10 disposed at the opening 1*a*. In this case, the zipper strap structure 10 provides a user with operation sounds or a feeling of manipulation due to a regular pattern structure while the internal coupling unit 110 including the first head portions 112-1 and the second head portions 112-2 disposed alternately is coupled to or decoupled from the external coupling unit 120 as described above. Since the user can clearly recognize how much the packaging bag 1 is opened or closed, the packaging bag 1 can be more conveniently used. In addition, since the structure of the internal coupling unit 110 and the external coupling unit 120 described above tightly seal the opening 1*a* in a state where the zipper strap structure 10 is coupled, the contents in the packaging bag 1 can be kept without leakage. The packaging bag 1 comprising the zipper strap structure 10 can be formed in this manner.

However, an application range of the zipper strap structure 10 does not have to be limited to the packaging bag or the like, and thus the zipper strap structure 10 can be widely applied to other products which are to be opened and closed by using a zipper.

Hereinafter, a manufacturing method for the zipper strap structure according to the invention will be described in detail with reference to FIGS. 10 to 14. Since the zipper strap structure to be mentioned below is substantially the same as the above-described zipper strap structure, descriptions of specific features which are not mentioned otherwise are also completely substituted with the above-provided description thereof.

Figure 10:
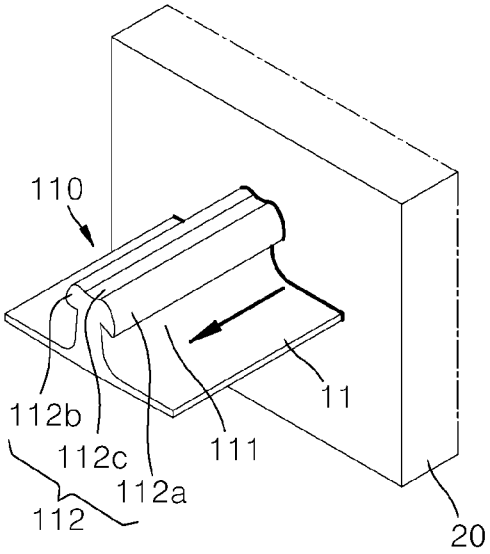
FIGS. 10 to 12 are views illustrating an exemplary manufacturing method for the zipper strap structure according to the embodiment of the invention.
Figure 11:
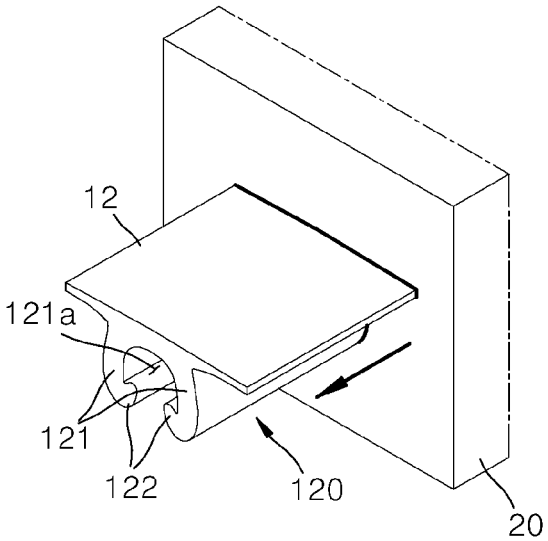
Figure 12:
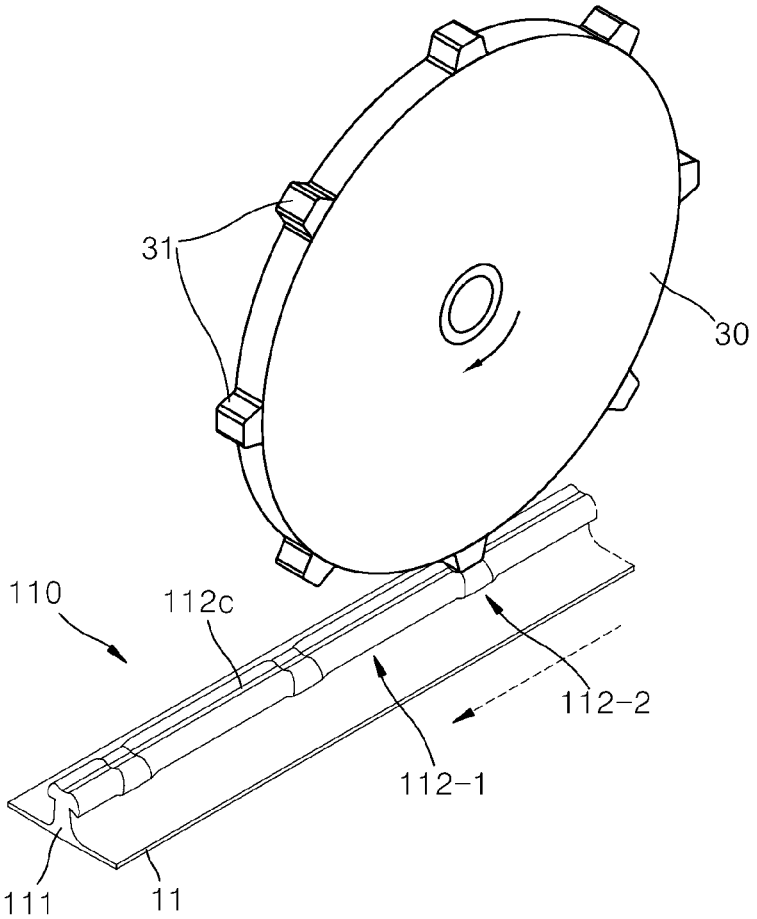
Figure 13:
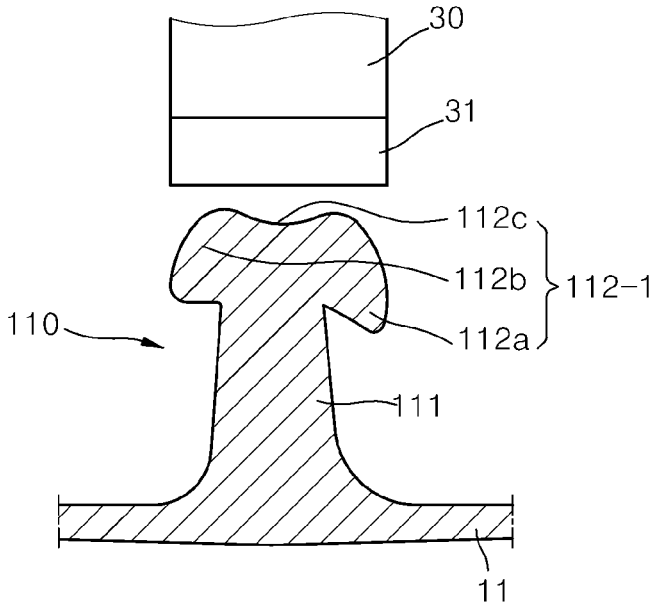
FIGS. 13 and 14 are views more specifically illustrating a process of pressurizing a head portion by a pressurizing device in FIG. 12 in the manufacturing method for the zipper strap structure.
Figure 14:
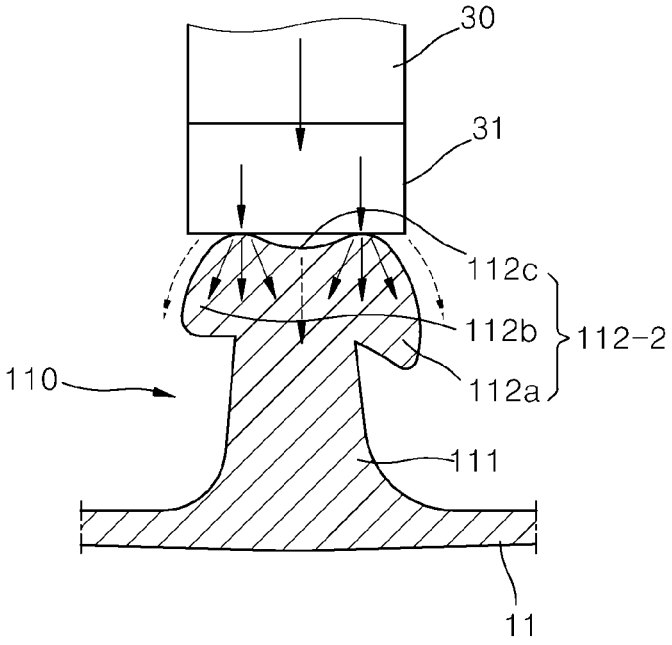

FIGS. 10 to 12 are views illustrating an exemplary manufacturing method for the zipper strap structure according to the embodiment of the invention. FIGS. 13 and 14 are views more specifically illustrating a process of pressurizing a head portion by a pressurizing device in FIG. 12 in the manufacturing method for the zipper strap structure.

The above-described zipper strap structure (refer to reference sign 10 in FIG. 1) can be manufactured specifically in the following method. The zipper strap structure can be manufactured by applying extrusion molding and compression molding in this order.

Specifically, the manufacturing method for the zipper strap structure includes the following steps. First, the first strap 11 and the internal coupling unit 110 are molded by the extrusion molding to have a uniform cross section, the internal coupling unit including the column portion 111 which projects from the first strap 11 and is extended in the length direction of the first strap 11 and the head portion 112 which has the pair of latching protrusions 112*a* and 112*b* formed to expand in the width direction of the first strap 11 from the end of the column portion 111 and to be extended in the length direction of the first strap 11 and the central separation groove 112*c* that is formed by concavely indenting the outer end surface of the column portion 111 between the latching protrusions 112*a* and 112*b* and is extended in the length direction of the first strap 11 [Step (a), refer to FIG. 10].

Subsequently, parts of the head portion are repeatedly pressed by a pressurizing device 30 to deform the cross section of the internal coupling unit 110, where pressure is applied to the central separation groove 112*c* to pressurize and expand the latching protrusions of the second head portions 112-2 toward both sides, and the first head portions 112-1 which are disposed to have the first height (refer to reference sign a in FIG. 3) with respect to the first strap 11 and the second head portions 112-2 which are disposed to have the second height (refer to reference sign a' in FIG. 4) which is lower than the first height with respect to the first strap 11 are alternately arranged in the length direction of the first strap 11 [Step (b), refer to FIG. 12].

Additionally, the second strap 12 and the external coupling unit 120 can be molded by the extrusion molding to have a uniform cross section, the external coupling unit including the pair of wall portions 121 which projects from the second strap 12, is extended in the length direction of the second strap 12, and is disposed separately from each other, with the accommodation space 121*a* being interposed between the wall portions and the accommodation space accommodating the head portion 112, and the pair of hook portions 122 which is bent from the ends of the wall portions 121 toward the accommodation space 121*a* and is extended in the length direction of the second strap 12 [Step (c), refer to FIG. 11].

In other words, the manufacturing method for the zipper strap structure can include processes of integrally molding the first strap 11 and the internal coupling unit 110 in an extrusion molding method [Step (a)] and pressurizing the internal coupling unit 110 by the pressurizing device 30 and forming the first head portions 112-1 and the second head portions 112-2 at the internal coupling unit 110 [Step (b)]. On the other hand, the second strap 12 and the external coupling unit 120 can be manufactured only by the extrusion molding method without a pressurizing process [Step (c)]. The step of forming the second strap 12 and the external coupling unit 120 [Step (c)] is independent from the other steps of forming the first strap 11 and the internal coupling unit 110 [Step (a) and Step (b)] and thus may be performed together with one of the other steps. The extrusion process of the first strap 11 and the internal coupling unit 110 and the extrusion process of the second strap 12 and the external coupling unit 120 are first described as follows.

For example, two sets thereof can be molded by being pushed out with pressure to have same shapes from extruders 20, respectively. Such a process is conceptually illustrated in FIGS. 10 and 11. The extruders 20 can have respective nozzles at the ends thereof, and the respective nozzles can be formed to have a shape corresponding to a cross section of the first strap 11 and the internal coupling unit 110 and a shape corresponding to a cross section of the second strap 12 and the external coupling unit 120. When a molten material is pressurized to be ejected through the nozzles, the first strap 11 and the internal coupling unit 110 having the above-described cross-sectional shape can be formed as illustrated in FIG. 10, and the second strap 12 and the external coupling unit 120 having the above-described cross-sectional shape can be formed as illustrated in FIG. 11. Although not illustrated, individual extrudates can be cooled with cooling water or the like outside the extruders 20.

Incidentally, since the extrudates are molded to have the same cross section through the extrusion molding, a process of applying pressure to the extruded first strap 11 and internal coupling unit 110 by the pressurizing device 30 again to change the height and the width of the head portion 112 is performed. Such a pressurizing process is illustrated in FIG. 12. For example, the pressurizing device 30 can be formed by a rotating body having cogs 31 and enables the cogs 31 to repeatedly come into contact with the top of the head portion while rotating the rotating body. Heat can be provided together with pressure during pressurization. For example, the pressurizing device 30 can perform pressurization in a state of being heated to an appropriate temperature, thereby providing heat. Such a process [Step (c)] can be a process of changing a cross section by repeatedly pressing again the head portion (refer to reference sign 112 in FIG. 10) molded to have the same cross section through the extrusion molding [Step (a)]. In particular, the cogs 31 can apply pressure to the central separation groove 112*c* of the head portion 112 to pressurize and expand the latching protrusions of the second head portions 112-2 toward both sides.

The pressurizing process is illustrated in more detail in FIGS. 13 and 14. FIG. 13 illustrates a state before the cogs 31 of the pressurizing device 30 press the central separation groove 112*c*, and thus is substantially the same as the first head portions 112-1. In this state, when the cogs 31 of the pressurizing device 30 are rotated to pressurize the central separation groove 112*c*, the second head portions 112-2 having a lower height are formed as illustrated in FIG. 14. In other words, unpressurized parts are formed into the first head portions 112-1 having the first height, and pressurized parts are formed into the second head portions 112-2 having the second height lower than the first height. In particular, the pressure can be applied to the central separation groove 112*c* by using the cogs 31, and thereby the latching protrusions 112*a* and 112*b* of the second head portions 112-2 can be pressurized and expanded toward both sides. In this case, the pressure is distributed by the central separation groove 112*c* such that the pressure is transmitted to both sides of the groove in a balanced way as illustrated, and thereby the height of the second head portions 112-2 can be lowered without buckling as described above while the column portion 111 is substantially maintained to be perpendicular to the strap.

In addition, the pressure distribution effect of the central separation groove 112*c* causes the latching protrusions 112*a* and 112*b* on both sides to be pressurized and expanded toward opposite sides of each other, thus causing the width (refer to reference sign F' in FIG. 5) of the second head portion 112-2 to be expanded while causing the height thereof to be lowered. Even in this case, since the pressure is transmitted through the central separation groove 112*c* to both sides thereof in a balanced way, the latching protrusions 112*a* and 112*b* maintain a very accurate shape without deformation of the shape due to crushing or the like thereof. In other words, the latching protrusions 112*a* and 112*b* having the accurate shape without a substantially big difference from the unpressurized first head portions 112-1 can be formed at the second head portions 112-2 by using the central separation groove 112*c*. The pressure distributed to both sides of the central separation groove 112*c* in the balanced way can press the column portion 111 on both sides thereof in a balanced way to increase only the width (refer to reference sign c' in FIG. 4) of the column portion supporting the second head portions 112-2 without buckling.

As described above, when the internal coupling unit 110 is coupled to the external coupling unit 120, the deformation in the pressurizing process [Step (b)] causes the gaps b1' and b2' between the latching protrusions 112*a* and 112*b* of the second head portion 112-2 and the hook portions 122 of the external coupling unit 120 to be more reduced than the gaps b1 and b2 between the latching protrusions 112*a* and 112*b* of the first head portions 112-1 and the hook portions 122 of the external coupling unit 120. Hence, this enables the above-described differences between the first head portions 112-1 and the second head portions 112-2 to be generated. In other words, as described above, since the gaps b1' and b2' between the latching protrusions 112*a* and 112*b* of the second head portions 112-2 and the hook portions 122 are relatively small, the second head portions can be more strongly coupled to the external coupling unit 120 than the first head portions 112-1 can. Hence, when the external coupling unit 120 and the internal coupling unit 110 are pushed to be coupled to each other or are pulled out to be decoupled from each other, a subtle difference in external force, a difference in coupling or decoupling time, a difference in elastic force generated due to a structural difference, a difference in vibration (or vibration sound) due to the difference in elastic force, or the like can be regularly generated. Hence, sound effects resulting from the differences can be generated when the external coupling unit 120 and the internal coupling unit 110 are opened or closed. In addition, since a user touches both the external coupling unit 120 and the internal coupling unit 110 in a way of rubbing or the like while applying pressure thereto by hand, the user can more strongly feel regular changes of the internal coupling unit 110 even by a feeling of touch during contact.

The deformation process by the pressure is unique and effective to the invention, and thus effects thereof are more clearly found when compared to comparative examples. Hereinafter, the effects of the invention will be more specifically described by comparison between the embodiment of the invention and the comparative examples with micrographs.

Figure 15:
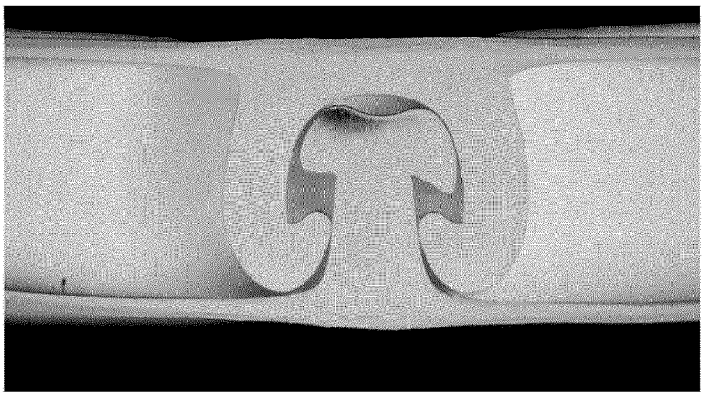
FIGS. 15 and 16 are micrographs illustrating cross sections of the zipper strap structure according to the embodiment of the invention.
Figure 16:
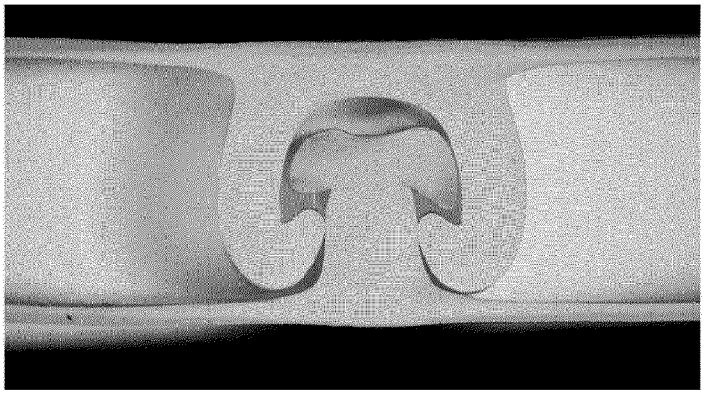

FIGS. 15 and 16 are micrographs illustrating cross sections of the zipper strap structure according to the embodiment of the invention. FIGS. 17 to 20 are micrographs illustrating cross sections of the comparative examples. The drawings are micrographs imaged by enlarging cross sections cut from the zipper strap structure according to the embodiment of the invention and the comparative examples.

FIGS. 15 and 16 illustrate micrographs of the cross sections of the zipper strap structure according to the embodiment of the invention. FIG. 15 illustrates a micrograph of a cross section on a side of the unpressurized first head portion (refer to reference sign 112-1 in FIG. 3), and FIG. 16 illustrates a micrograph of a cross section on a side of the second head portion (refer to reference sign 112-2 in FIG. 4) formed by being pressurized (with heat). In the respective drawings, the latching protrusions (refer to reference signs 112*a* and 112*b* in FIGS. 3 and 4) have clear shapes, the central separation groove (refer to reference sign 112*c* in FIGS. 3 and 4) are clearly realized, and the column portion (refer to reference sign 111*b* in FIGS. 3 and 4) are observed to have a shape extended perpendicularly to the first strap (refer to reference sign 11 in FIGS. 3 and 4) without buckling. A zipper strap structure which actually has the cross section can be manufactured by the above-described manufacturing method of the invention.

Figure 17:
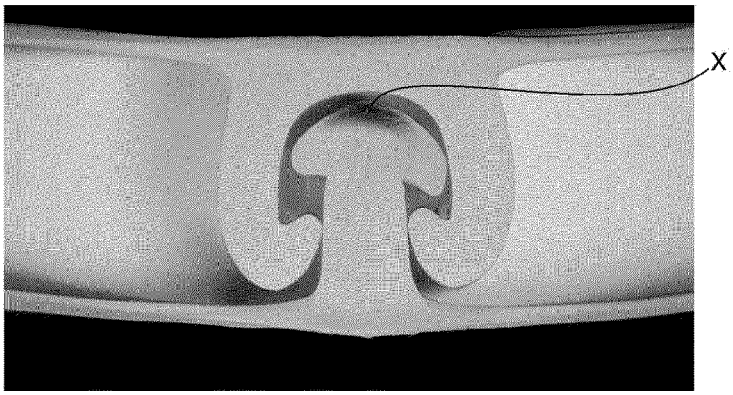
FIGS. 17 to 20 are micrographs illustrating cross sections of comparative examples.
Figure 18:
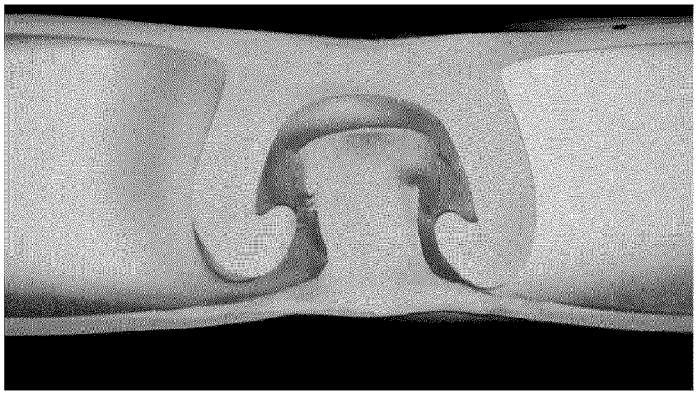
Figure 19:
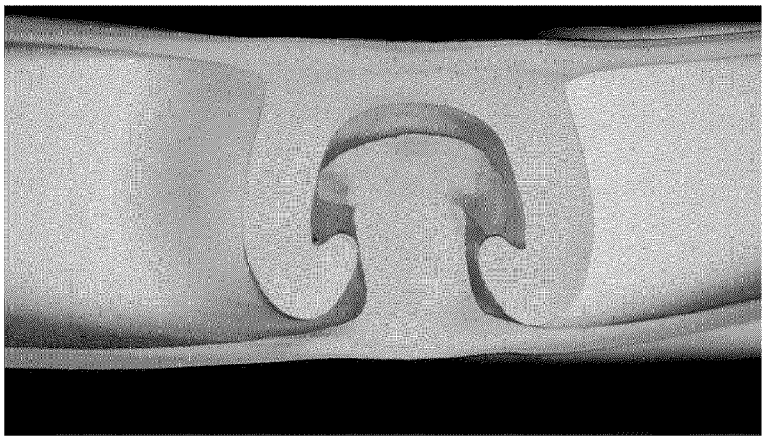
Figure 20:
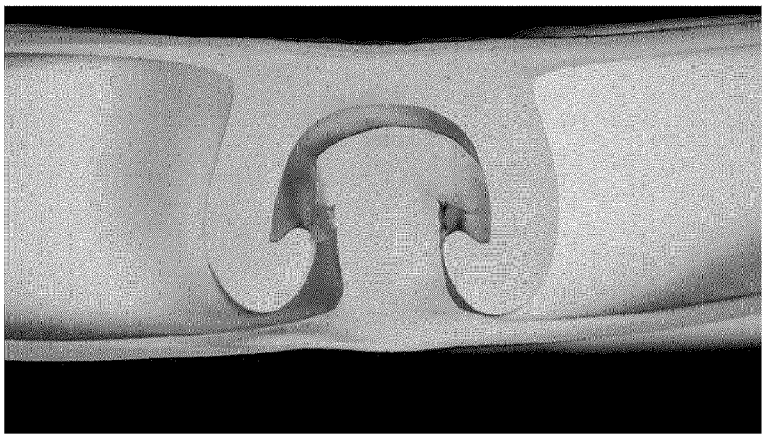

On the other hand, cross sections of the comparative examples (which can be a zipper strap product including an external coupling unit and an internal coupling unit that have shapes similar to those of the invention) can be observed in FIGS. 17 to 20. FIG. 17 illustrates a structure (projection structure from bottom to top of the micrograph) corresponding to the internal coupling unit of the invention and shows that a groove structure such as the central separation groove 112*c* is not formed. Instead, a projection portion X which projects upward at the center is observed. FIGS. 18 to 20 illustrate examples deformed by applying pressure to the structure in FIG. 17. In other words, FIG. 17 can correspond to the first head portion (structure before applying pressure) of the invention, and FIGS. 18 to 20 can all correspond to the second head portion [structure deformed by applying pressure (together with heat)] of the invention. However, FIGS. 18 to 20 clearly show a shape bent sideways due to buckling, and thus a tight coupling structure with an upper structure corresponding to the external coupling unit is not observed to be formed at all. In particular, in a case of the comparative examples, when the pressure is applied and the structure is deformed, parts corresponding to the latching protrusions of the invention are observed to be crushed as illustrated in FIGS. 18 to 20, thus being unlikely to fulfill a function thereof.

The comparative examples show what results is obtained when an internal coupling unit having the projection portion X which projects at the center thereof as illustrated in FIG. 17 is directly pressurized (together with heat). When the projection portion X is formed, the applied pressure is difficult to distribute, thus the entire structure corresponding to the internal coupling unit is uniformly deformed and a structure corresponding to the column portion mostly buckles. This shows that a structure which is pressed while maintaining a normal shape, like the second head portion, is difficult to form. In addition, since a structure corresponding to the latching protrusion is crushed or destroyed due to uninform pressure while buckling, it is difficult to use such a structure as the zipper strap.

When the pressurized parts [FIGS. 18 to 20] buckle and are crushed as described in the comparative examples, the structure in which the first head portions and the second head portions are repeated to form a regular pattern as in the invention is difficult to form. Even when the structure is forcibly pressurized and deformed, the pressurized parts buckle and are crushed uniformly as in FIGS. 18 to 20. Hence, the entire zipper strap is not uniformly opened or closed, thus being unlikely to maintain intended performance. Even when the zipper is closed, contents can leak from buckling or crushed parts as illustrated in the micrographs, sound effects are not likely to be produced when the zipper is opened or closed, and rather uninform sound effects or touch feelings can result in uneasiness. Such a difference from the invention can be generated due to absence of the pressure distribution structure such as the central separation groove 112*c* and can be observed through comparison to the comparative example including the projection portion X. Hence, the effects of the invention can be proved to be significant through the comparison.

As described above, the embodiments of the invention are described with reference to the accompanying drawings; however, a person with ordinary skill in the technical field to which the invention pertains can understand that the invention can be implemented as another embodiment without modifying the technical idea or an essential feature of the invention. Therefore, the embodiments described above are to be understood only as examples in every aspect and not as examples limiting the invention.

The zipper strap structure of the invention includes internal and external units that are coupled to each other with very high accuracy and precision. In addition, when the zipper strap structure is operated, a user can intuitively recognize whether the zipper strap structure is opened or closed by senses of touch and hearing, and thus the zipper strap structure of the invention can be applied to a packaging bag or the like and can be practically used to seal contents therein. In addition, the invention can be applied to other various products including a zipper which can be opened and closed. In addition, a manufacturing method of the invention not only enables the zipper strap structure improved as described above to be very conveniently and effectively manufactured but also remarkably reduces a defect rate in a manufacturing process, and thus the manufacturing method of the invention can be applied to the manufacturing of various products which have to include an improved zipper structure. Hence, the invention has industrial applicability.

What is claimed is:

1. A manufacturing method for a zipper strap structure, comprising:

molding a first strap and an internal coupling unit to have a uniform cross section by extrusion molding, the internal coupling unit including a column portion which projects from the first strap and is extended in a length direction of the first strap and a head portion which has a pair of latching protrusions formed to expand in a width direction of the first strap from an end of the column portion and to be extended in the length direction of the first strap and a central separation groove that is formed by concavely indenting an outer end surface of the column portion between the latching protrusions and is extended in the length direction of the first strap; and repeatedly pressing parts of the head portion and deform a cross section of the internal coupling unit by a pressurizing device, where pressure is applied to the central separation groove to pressurize and expand the latching protrusions of the head portion toward both sides and first head portions and the second head portions are alternately arranged in the length direction of the first strap, the first head portions being disposed to have a first height with respect to the first strap, the second head portions being disposed to have a second height which is lower than the first height with respect to the first strap.

2. The manufacturing method according to claim 1, further comprising:

molding a second strap and an external coupling unit to have a uniform cross section by extrusion molding, the external coupling unit including a pair of wall portions which projects from the second strap, is extended in a length direction of the second strap, and is disposed separately from each other, with an accommodation space being interposed between the wall portions and the accommodation space accommodating the head portion, and a pair of hook portions which is bent from ends of the wall portions toward the accommodation space and is extended in the length direction of the second strap.

3. The manufacturing method according to claim 1, wherein the pressure is distributed by the central separation groove such that the pressure is transmitted to the both sides in a balanced way and thereby the height of the second head portions can be lowered without buckling.

4. The manufacturing method according to claim 1, wherein a depth of the central separation groove does not exceed a height of the head portion only, the height being obtained by subtracting a height of the column portion from a height of the head portion.

5. The manufacturing method according to claim 2, wherein, when the internal coupling unit is coupled to the external coupling unit, a gap between one latching protrusion of the second head portions and one of the hook portions of the external coupling unit is smaller than a gap between one latching protrusion of the first head portions and one of the hook portions of the external coupling unit.

6. The manufacturing method according to claim 2, wherein, when the internal coupling unit is coupled to the external coupling unit, a difference between a gap between a latching protrusion of the first head portions and one of the hook portions of the external coupling unit and a gap between a latching protrusion of the second head portions and one of the hook portions of the external coupling unit is smaller than a difference between the first height and the second height.

* * * * *